US005683615A

United States Patent [19]

Munoz

[11] Patent Number: 5,683,615

[45] Date of Patent: Nov. 4, 1997

[54] MAGNETORHEOLOGICAL FLUID

[75] Inventor: Beth C. Munoz, Apex, N.C.

[73] Assignee: Lord Corporation, Cary, N.C.

[21] Appl. No.: 664,035

[22] Filed: Jun. 13, 1996

[51] Int. Cl.[6] ..... H01F 1/28

[52] U.S. Cl. ..... 252/62.52; 252/62.54

[58] Field of Search ..... 252/62.52, 62.54

[56] References Cited

U.S. PATENT DOCUMENTS

| | | | |
|---|---|---|---|
| 2,751,352 | 6/1956 | Bondi | 252/62.5 |
| 2,805,997 | 9/1957 | Benoit, Jr. et al. | 252/42.7 |
| 2,886,151 | 5/1959 | Winslow | 192/21.5 |
| 4,063,000 | 12/1977 | Aonuma et al. | 428/403 |
| 4,164,473 | 8/1979 | Coupland et al. | 252/32.7 |
| 4,253,886 | 3/1981 | Aonuma et al. | 148/105 |
| 4,834,898 | 5/1989 | Hwang | 252/62.56 |
| 4,889,647 | 12/1989 | Rowan et al. | 252/42.7 |
| 4,990,271 | 2/1991 | Francis | 252/33.6 |
| 5,043,070 | 8/1991 | Hwang | 210/634 |
| 5,094,769 | 3/1992 | Anderson, Jr. et al. | 252/71 |
| 5,137,647 | 8/1992 | Karol | 252/33.6 |
| 5,143,637 | 9/1992 | Yokouchi et al. | 252/62.52 |
| 5,213,704 | 5/1993 | Anderson, Jr. et al. | 252/75 |
| 5,271,858 | 12/1993 | Clough et al. | 252/74 |
| 5,382,373 | 1/1995 | Carlson | 252/62.55 |
| 5,412,130 | 5/1995 | Karol | 556/57 |

FOREIGN PATENT DOCUMENTS

| | | |
|---|---|---|
| WO 94/10692 | 5/1994 | WIPO . |
| WO 94/10693 | 5/1994 | WIPO . |
| WO 94/10694 | 5/1994 | WIPO . |

OTHER PUBLICATIONS

"Vanderbilt Lubricant Additives" R.T. Vanderbilt Company, Inc.; Technical Bulletin No. 941; Jun. 1994.

Japan JP B –89–021202 Apr. 20, 1989.

Japan (Derwent Abstract) JP A –62–195729 Aug. 28, 1987.

(Derwent Abstract) DD A –296574 Jul. 4, 1990.

*Primary Examiner*—Melissa Bonner

*Attorney, Agent, or Firm*—Wayne W. Rupert

[57] ABSTRACT

A magnetorheological fluid that includes magnetic-responsive particles, a carrier fluid and at least one thiophosphorus and/or thiocarbamate additive. Preferably, the thiophosphorus or thiocarbamate additive is a metallic dialkyldithiophosphate or a metallic dialkyldithiocarbamate.

44 Claims, No Drawings

MAGNETORHEOLOGICAL FLUID

BACKGROUND OF THE INVENTION

This invention relates to fluids that exhibit substantial increases in flow resistance when exposed to magnetic fields.

Fluid compositions that undergo a change in apparent viscosity in the presence of a magnetic field are commonly referred to as Bingham magnetic fluids or magnetorheological fluids. Magnetorheological fluids typically include magnetic-responsive particles dispersed or suspended in a carrier fluid. In the presence of a magnetic field, the magnetic-responsive particles become polarized and are thereby organized into chains of particles or particle fibrils within the carrier fluid. The chains of particles act to increase the apparent viscosity or flow resistance of the overall materials resulting in the development of a solid mass having a yield stress that must be exceeded to induce onset of flow of the magnetorheological fluid. The force required to exceed the yield stress is referred to as the "yield strength". In the absence of a magnetic field, the particles return to an unorganized or free state and the apparent viscosity or flow resistance of the overall materials is correspondingly reduced. Such absence of a magnetic field is referred to herein as the "off-state".

Magnetorheological fluids are useful in devices or systems for controlling vibration and/or noise. For example, magnetorheological fluids are useful in providing controllable forces acting upon a piston in linear devices such as dampers, mounts and similar devices. Magnetorheological fluids are also useful for providing controllable torque acting upon a rotary in rotary devices. Possible linear or rotary devices could be clutches, brakes, valves, dampers, mounts and similar devices. In these applications magnetorheological fluid can be subjected to shear forces, as high as 70 kPa, often significantly high, and shear rates in the order of 20,000 to 50,000 $sec^{-1}$ causing extreme wear on the magnetic-responsive particles. As a result, the magnetorheological fluid thickens substantially over time leading to increasing off-state viscosity. The increasing off-state viscosity leads to an increase in off-state force experienced by the piston or rotor. This increase in off-state force hampers the freedom of movement of the piston or rotor at off-state conditions. In addition, it is desirable to maximize the ratio of on-state force to off-state force in order to maximize the controllability offered by the device. Since the on-state force is dependent upon the magnitude of the applied magnetic field, the on-state force should remain constant at any given applied magnetic field. If the off-state force increases over time because the off-state viscosity is increasing but the on-state force remains constant, the on-state/off-state ratio will decrease. This on-state/off-state ratio decrease results in undesirable minimization of the controllability offered by the device. A more durable magnetorheological fluid that does not thicken over an extended period of time, preferably over the life of the device that includes the fluid, would be very useful.

Magnetorheological fluids are described, for example, in U.S. Pat. No. 5,382,373 and published PCT International Patent Applications WO 94/10692, WO 94/10693 and WO 94/10694.

U.S. Pat. No. 5,271,858 relates to an electrorheological fluid that includes a carbon, glass, silicate, or ceramic particulate having an electrically conductive tin dioxide coating. The patent provides an extensive list of possible carrier fluids for the electrorheological fluid that includes esters and amides of an acid of phosphorus, hydrocarbon materials, silicates, silicones, ether compounds, polyphenyl thioether compounds, phenylmercaptobiphenyl compounds, mono- and di alkylthiophenes, chlorinated compounds and esters of polyhydric compounds.

U.S. Pat. No. 5,043,070 relates to an organic solvent extractant that includes an organic solvent extractant and magnetic particles, wherein the surface of the magnetic particles has been coated with a surfactant that renders the particles hydrophobic. The surfactant may be selected from ethers, alcohols, carboxylates, xanthates, dithiophosphates, phosphates, hydroxamates, sulfonates, sulphosuccinates, taurates, sulfates, amino acids or amines. Sodium dialkyl dithiophosphate and aryl dithiophosphoric acid are the only dithiophosphates mentioned in the extensive list of possible surfactants. There is no example, however, that includes a dithiophosphate.

U.S. Pat. No. 4,834,898 relates to an extracting reagent for magnetizing particles of nonmagnetic material that comprises water that includes magnetic particles having a 2 layer surfactant coating. The surfactant layers may be selected from ethers, alcohols, carboxylates, xanthates, dithiophosphates, phosphates, hydroxamates, sulfonates, sulphosuccinates, taurates, sulfates, amino acids or amines.

U.S. Pat. No. 4,253,886 relates to a method for preparing a ferromagnetic metal powder of particle size from 50–1000 angstroms. The particles are washed with a solution that contains (a) a volatile corrosion inhibitor; (b) (i) water, (ii) a water miscible organic solvent or (iii) a combination of (i) and (ii); and (c) an anionic surface active agent. Salt of a dithiophosphoric acid ester is mentioned as one of many possible types of surface active agents.

JP-B-89021202 relates to a magnetic powder that is iron or mainly iron that is surface treated with dialkyl dithiocarbamates of formula $R_1R_2N—CS—S—R_3$ wherein $R_1$ and $R_2$ are alkyl and $R_3$ is alkali metal or ammonium. The powder is used to formulate magnetic ink by mixing it with methyl ethyl ketone, methyl isobutyl ketone, cyclohexanone, vinylchloride/vinyl acetate copolymer, polyurethane resin, stearic acid, lecithin and a curing agent.

JP-A-62195729 relates to a magnetic lacquer for coating onto a substrate to make a recording medium. According to an English language abstract an example of the lacquer includes 100 parts by weight (pbw) Co-containing $\gamma$-$Fe_2O_3$, 4 pbw $\alpha$-$Fe_2O_3$ powder, 4 pbw Mo-dithiocarbamate, 12 pbw nitrocellulose, 8 pbw polyurethane resin, 75 pbw cyclohexanone, 75 pbw toluene, 7.5 pbw methyl isobutyl ketone and 5 pbw polyisocyanate.

DD-A-296574 relates to a magnetic liquid that may includes magnetite monodomain particles with particle sizes of 5–20 nm. Zn dialkyldithiophosphide is included as a component at some stage in the production of the fluid, but it is not clear from an English language abstract what other components are present in a fluid with the Zn dialkyldithiophosphide.

None of these documents suggest any solution to the problem of providing a more durable magnetorheological fluid.

SUMMARY OF THE INVENTION

According to a first embodiment of the invention there is provided a magnetorheological fluid that includes magnetic-responsive particles, a carrier fluid and at least one thiophosphorus additive having a structure represented by formula A:

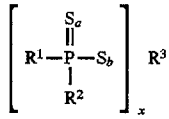

wherein $R^1$ and $R^2$ each individually have a structure represented by:

$$Y-((C)(R^4)(R^5))_n-(O)_w-$$

wherein Y is hydrogen or a functional group—containing moiety such as an amino, amido, imido, carboxyl, hydroxyl, carbonyl, oxo or aryl;

n is an integer from 2 to 17 such that $C(R^4)(R^5)$ is a divalent group having a structure such as a straight-chained aliphatic, branched aliphatic, heterocyclic, or aromatic ring;

$R^4$ and $R^5$ can each individually be hydrogen, alkyl or alkoxy; and w is 0 or 1.

According to a second embodiment of the invention them is provided a magnetorheological fluid that includes magnetic-responsive particles, a carrier fluid and at least one thiocarbamate additive having a structure represented by formula B:

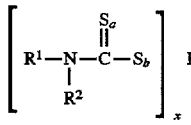

wherein $R^1$ and $R^2$ each individually have a structure represented by:

$$Y-((C)(R^4)(R^5))_n-$$

wherein Y is hydrogen or a functional group—containing moiety such as an amino, amido, imido, carboxyl, hydroxyl, carbonyl, oxo or aryl;

n is an integer from 2 to 17 such that $C(R_4)(R_5)$ is a divalent group having a structure such as a straight-chained aliphatic, branched aliphatic, heterocyclic, or aromatic ring; and $R^4$ and $R^5$ can each individually be hydrogen, alkyl or alkoxy.

$R^3$ of formula A or B can be a metal ion such as molybdenum, tin, antimony, lead, bismuth, nickel, iron, zinc, silver, cadmium or lead or a nonmetallic moiety such as hydrogen, a sulfur-containing group, alkyl, alkylaryl, arylalkyl, hydroxyalkyl, an oxy-containing group, amido or an amine. Subscripts a and b of formula A or B are each individually 0 or 1, provided a+b is at least equal to 1 and x of formula A or B is an integer from 1 to 5 depending upon the valence number of $R^3$.

The magnetorheological fluids of the invention exhibit superior durability because of a substantial decrease in the thickening of the fluid over a period of use.

There also is provided according to the invention a magnetorheological device that includes a housing that contains the above-described magnetorheological fluids.

DETAILED DESCRIPTION OF THE PREFERRED EMBODIMENTS $R^1$ and $R^2$ of the thiophosphorus or thiocarbamate additive can be any group that imparts solubility with the carrier fluid. $R^1$ and $R^2$ preferably individually have the structure depicted previously for the thiophosphorus and thiocarbamate additives, respectively.

One possibility for $R^1$ and/or $R^2$ for both the thiophosphorus and thiocarbamate is an alkyl group. In general, any alkyl group should be suitable, but alkyls having from 2 to 17, particularly 3 to 16, carbon atoms are preferred. The alkyl could be branched if $R^4$ and/or $R^5$ are themselves alkyls or the alkyl could be straight-chained. Illustrative alkyl groups include methyl, ethyl, propyl, isopropyl, tert-butyl, pentyl, 2-ethylhexyl, dodecyl, decyl, hexadecyl, nonyl, octodecyl, and 2-methyl dodecyl.

Another possibility for $R^1$ and/or $R^2$ for both the thiophosphorus and thiocarbamate is an aryl group. In general, any aryl groups should be suitable. The aryl group can be directly bonded to the phosphorus atom of the thiophosphorus or it can be bonded via a divalent linking group such as an alkylene or an amido group. The aryl group can be bonded to the nitrogen atom of the of the thiocarbamate via a divalent linking group such as an alkylene or an amido group. Illustrative aryl-containing groups include phenyl, benzoyl and naphthyl. In general, any alkylaryl groups should be suitable. Illustrative alkylaryl groups include benzyl, phenylethyl, phenylpropyl and alkyl-substituted phenyl alcohol.

A further possibility for $R^1$ and/or $R^2$ for the thiophosphorus is an alkoxy group (in other words, subscript w is 1). In general, any alkoxy should be suitable, but alkoxy groups having from 2 to 17, preferably 3 to 16, carbon atoms are preferred. Illustrative alkoxy groups include methoxy, ethoxy, propoxy, and butoxy.

If Y is an amino group, possible $R^1$ and/or $R^2$ groups for the thiophosphorus and thiocarbamate include butylamine, nonylamine, hexadecylamine and decylamine. If Y is an amido group, possible $R^1$ and/or $R^2$ groups include butynoamido, decynoamido, pentylamido and hexamido. If Y is a hydroxy group, possible $R^1$ and/or $R^2$ groups include decanol, hexanol, pentanol, and alkyl groups that include a hydroxy anywhere along the chain such as, for example, 4-decanol. If Y is a carbonyl or oxo group, possible $R^1$ and/or $R^2$ groups include 2-decanone, 3-decanone, 4-decanone, 2-pentanone, 3-pentanone, 4-pentanone and decanophenone. Y could also be a combination of the above-described functional groups so that $R^1$ or $R^2$ could be a multi-functional moiety such as benzamido.

As described above, $R^4$ and $R^5$ can be hydrogen, alkyl or alkoxy. For example, if $R^1$ or $R^2$ is an aryl or straight-chained alkyl, $R^4$ and $R^5$ are hydrogen. If $R^1$ or $R^2$ is a substituted aryl or a branched alkyl, $R^4$ and $R^5$ are alkyl or alkoxy. The number of carbons in the alkyl or alkoxy for $R^4$ and $R^5$ can vary, but the preferred range is 1 to 16, more preferably 1 to 10.

Preferred groups for $R^1$ and $R^2$ of formula A (the thiophosphorus) are decyl, octyl, nonyl, dodecyl, hexadecyl, undecyl, hexyl, butoxy, pentoxy, decoxy and hexaoxy. Preferred groups for $R^1$ and $R^2$ of formula B (the thiocarbamate) are decyl, octyl, nonyl, dodecyl, hexadecyl, undecyl and hexyl.

$R^3$ of either the thiophosphorus or thiocarbamate additive can be a metallic ion such as molybdenum, tin, antimony, lead, bismuth, nickel, iron, zinc, silver, cadmium or lead and the carbides, oxides, sulfides or oxysulfides thereof. Preferably, $R^3$ is antimony, zinc, cadmium, nickel or molybdenum.

$R^3$ also can be a nonmetallic moiety such as hydrogen, alkyl, alkylaryl, arylalkyl, hydroxyalkyl, oxy-containing group, amido or amino. The alkyl, aryl, alkylaryl, arylalkyl, hydroxyalkyl, or oxy-containing groups could include functional groups such as amino, amido, carboxy or carbonyl.

In general, any alkyl group should be suitable, but alkyls having from 2 to 20, preferably 3 to 16, carbon atoms are preferred. The alkyls could be straight chain or branched. Illustrative alkyl groups include methyl, ethyl, propyl, isopropyl, tert-butyl, pentyl, 2-ethylhexyl, dodecyl, decyl, hexadecyl and octadecyl. In general, any aryl groups should be suitable. Illustrative aryl groups include phenyl, benzylidene, benzoyl and naphthyl. In general, any amido-containing groups should be suitable. Illustrative amido groups include butynoamido, decynoamido, pentylamido and hexamido. In general, any amino groups should be suitable. Illustrative amino groups include butylamine, nonylamine, hexadecylamine and decylamine. In general, any alkylaryl or arylalkyl groups should be suitable. Illustrative alkylaryl or arylalkyls include benzyl, phenylethyl, phenylpropyl, and alkyl-substituted phenyl alcohol. In general, any oxy-containing groups should be suitable, but alkoxy groups having from 2 to 20, preferably 3 to 12, carbon atoms are preferred. Illustrative alkoxy groups include methoxy, ethoxy, propoxy, butoxy and heptoxy.

$R^3$ also can be a divalent group that links together two thiophosphorus or thiocarbamates units to form a dimer. In this instance, subscript x of formula A or B will be 2 and the thiocarbamate additive, for example, will have the following formula:

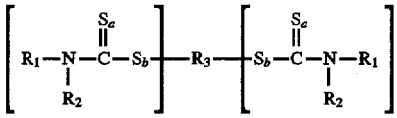

Possible divalent groups include alkylene. In general, any alkylene groups should be suitable, but those having from 1 to 16, preferably 1 to 8, carbon atoms are preferred. Illustrative alkylene groups include methylene and propylene. A commercially available example of an alkylene thiocarbamate is methylene bis(dibutyldithiocarbamate) available from R. T. Vanderbilt Co. under the tradename Vanlube® 7723.

Subscripts a and b of formulae A or B preferably are both 1. In other words, a dithiophosphorus or ditihocarbamate is the preferred additive.

Particularly preferred dithiophosphorus additives include sulfurized oxymolybdenum organophosphorodithioate available from R. T. Vanderbilt Co. under the tradename Molyvan® L, and antimony dialkylphosphorodithioates available from R. T. Vanderbilt Co. under the tradenames Vanlube® 622 and 648. Particularly preferred dithiocarbamates include molybdenum oxysulfide dithiocarbamate available from R. T. Vanderbilt Co. under the tradename Molyvan® A, organo molybdenum dithiocarbamate available from R. T. Vanderbilt Co. under the tradename Molyvan® 822, zinc diamyldithiocarbamate available from R. T. Vanderbilt Co. under the tradename Molyvan® AZ, lead diamyldithiocarbamate available from R. T. Vanderbilt Co. under the tradename Vanlube® 71, and antimony dialkyldithiocarbamate available from R. T. Vanderbilt Co. under the tradename Vanlube® 73.

The thiophosphorus or thiocarbamate additive that is added to the magnetorheological fluid preferably is in a liquid state at ambient room temperature and does not contain any particles above molecular size.

A mixture of a thiophosphorus additive and a thiocarbamate additive could also be used in a magnetorheological fluid. The thiophosphorus and/or thiocarbamate can be present in an amount of 0.1 to 12, preferably 0.25 to 10, volume percent, based on the total volume of the magnetorheological fluid.

It has also been surprisingly found that an advantageous synergistic effect can be achieved if other additives are included with the thiophosphorus and/or thiocarbamate. Examples of such supplemental or second additives include organomolybdenums, phosphates and sulfur-containing compounds.

The organomolybdenum additive can be a compound or complex whose structure includes at least one molybdenum atom bonded to or coordinated with at least one organic moiety. The organic moiety can be, for example, derived from a saturated or unsaturated hydrocarbon such as alkane, or cycloalkane; an aromatic hydrocarbon such as phenol or thiophenol; an oxygen-containing compound such as carboxylic acid or anhydride, ester, ether, keto or alcohol; a nitrogen-containing compound such as amidine, amine or imine; or a compound containing more than one functional group such as thiocarboxylic acid, imidic acid, thiol, amide, imide, alkoxy or hydroxy amine, and amino-thiol-alcohol. The precursor for the organic moiety can be a monomeric compound, an oligomer or polymer. A heteroatom such as =O, —S or ≡N also can be bonded to or coordinated with the molybdenum atom in addition to the organic moiety.

A particularly preferred group of organomolybdenums is described in U.S. Pat. No. 4,889,647 and U.S. Pat. No. 5,412,130, both incorporated herein by reference. U.S. Pat. No. 4,889,647 describes an organomolybdenum complex that is prepared by reacting a fatty oil, diethanolamine and a molybdenum source. U.S. Pat. No. 5,412,130 describes heterocyclic organomolybdates that are prepared by reacting diol, diamino-thiol-alcohol and amino-alcohol compounds with a molybdenum source in the presence of a phase transfer agent. An organomolybdenum that is prepared according to U.S. Pat. No. 4,889,647 and U.S. Pat. No. 5,412,130 is available from R. T. Vanderbilt Co. under the tradename Molyvan® 855.

Organomolybdenums that also might be useful are described in U.S. Pat. No. 5,137,647 which describes an organomolybdenum that is prepared by reacting an amine-amide with a molybdenum source, U.S. Pat. No. 4,990,271 which describes a molybdenum hexacarbonyl dixanthogen, U.S. Pat. No. 4,164,473 which describes an organomolybdenum that is prepared by reacting a hydrocarbyl substituted hydroxy alkylated amine with a molybdenum source, and U.S. Pat. No. 2,805,997 which describes alkyl esters of molybdic acid.

The organomolybdenum additive that is added to the magnetorheological fluid preferably is in a liquid state at ambient room temperature and does not contain any particles above molecular size.

The organomolybdenum additive can be present in an amount of 0.1 to 12, preferably 0.25 to 10, volume percent, based on the total volume of the magnetorheological fluid.

Useful phosphates include alkyl, aryl, alkylaryl, arylalkyl, amine and alkyl amine phosphates. Illustrative of such phosphates are tricresyl phosphate, trixylenyl phosphate, dilauryl phosphate, octadecyl phosphate, hexadecyl phosphate, dodecyl phosphate and didodecyl phosphate. A particularly preferred alkyl amine phosphate is available from R. T. Vanderbilt Company under the tradename Vanlube® 9123. Examples of sulfur-containing compounds include thioesters such as tetrakis thioglycolate, tetrakis(3-mercaptopropionyl) pentaerithritol, ethylene glycoldimercaptoacetate, 1,2,6-hexanetriol trithioglycolate, trimethylol ethane tri(3-mercaptopropionate), glycoldimercaptopropionate, bisthioglycolate, trimethylolethane trithioglycolate, trimethylolpropane tris(3-mercaptopropionate) and similar compounds and thiols such as 1-dodecylthiol, 1-decanethiol, 1-methyl-1-decanethiol, 2-methyl-2-decanethiol, 1-hexadecylthiol, 2-propyl-2-decanethiol, 1-butylthiol, 2-hexadecylthiol and similar compounds.

The magnetic-responsive particle component of the magnetorheological material of the invention can be comprised of essentially any solid which is known to exhibit magnetorheological activity. Typical magnetic-responsive particle components useful in the present invention are comprised of, for example, paramagnetic, superparamagnetic or ferromagnetic compounds. Superparamagnetic compounds are especially preferred. Specific examples of magnetic-responsive particle components include particles comprised of materials such as iron, iron oxide, iron nitride, iron carbide, carbonyl iron, chromium dioxide, low carbon steel, silicon steel, nickel, cobalt, and mixtures thereof. The iron oxide includes all known pure iron oxides, such as $Fe_2O_3$ and $Fe_3O_4$, as well as those containing small amounts of other elements, such as manganese, zinc or barium. Specific examples of iron oxide include ferrites and magnetites. In addition, the magnetic-responsive particle component can be comprised of any of the known alloys of iron, such as those containing aluminum, silicon, cobalt, nickel, vanadium, molybdenum, chromium, tungsten, manganese and/or copper.

The magnetic-responsive particle component can also be comprised of the specific iron-cobalt and iron-nickel alloys described in U.S. Pat. No. 5,382,373. The iron-cobalt alloys useful in the invention have an iron:cobalt ratio ranging from about 30:70 to 95:5, preferably ranging from about 50:50 to 85:15, while the iron-nickel alloys have an iron-:nickel ratio ranging from about 90:10 to 99:1, preferably ranging from about 94:6 to 97:3. The iron alloys may contain a small amount of other elements, such as vanadium, chromium, etc., in order to improve the ductility and mechanical properties of the alloys. These other elements are typically present in an amount that is less than about 3.0% by weight. Due to their ability to generate somewhat higher yield stresses, the iron-cobalt alloys are presently preferred over the iron-nickel alloys for utilization as the particle component in a magnetorheological material. Examples of the preferred iron-cobalt alloys can be commercially obtained under the tradenames HYPERCO (Carpenter Technology), HYPERM (F. Krupp Widiafabrik), SUPERMENDUR (Arnold Eng.) and 2V-PERMENDUR (Western Electric).

The magnetic-responsive particle component of the invention is typically in the form of a metal powder which can be prepared by processes well known to those skilled in the art. Typical methods for the preparation of metal powders include the reduction of metal oxides, grinding or attrition, electrolytic deposition, metal carbonyl decomposition, rapid solidification, or smelt processing. Various metal powders that are commercially available include straight iron powders, reduced iron powders, insulated reduced iron powders, cobalt powders, and various alloy powders such as [48%]Fe/[50%]Co/[2%]V powder available from UltraFine Powder Technologies.

The preferred magnetic-responsive particles are those that contain a majority amount of iron in some form. Carbonyl iron powders that are high purity iron particles made by the thermal decomposition of iron pentacarbonyl are particularly preferred. Carbonyl iron of the preferred form is commercially available from ISP Technologies, GAF Corporation and BASF Corporation.

The particle size should be selected so that it exhibits multi-domain characteristics when subjected to a magnetic field. The magnetic-responsive particles should have an average particle size distribution of at least about 0.1 μm, preferably at least about 1 μm. The average particle size distribution should range from about 0.1 to about 500 μm, with from about 1 to about 500 μm being preferred, about 1 to about 250 μm being particularly preferred, and from about 1 to about 100 μm being especially preferred.

The amount of magnetic-responsive particles in the magnetorheological fluid depends upon the desired magnetic activity and viscosity of the fluid, but should be from about 5 to about 50, preferably from about 15 to 40, percent by volume based on the total volume of the magnetorheological fluid.

The carrier component is a fluid that forms the continuous phase of the magnetorheological fluid. Suitable carrier fluids may be found to exist in any of the classes of oils or liquids known to be carrier fluids for magnetorheological fluids such as natural fatty oils, mineral oils, polyphenylethers, dibasic acid esters, neopentylpolyol esters, phosphate esters, polyesters (such as perfluorinated polyesters), synthetic cycloparaffin oils and synthetic paraffin oils, unsaturated hydrocarbon oils, monobasic acid esters, glycol esters and ethers, synthetic hydrocarbon oils, perfluorinated polyethers, and halogenated hydrocarbons, as well as mixtures and derivatives thereof. The carrier component may be a mixture of any of these classes of fluids. The preferred carrier component is non-volatile, non-polar and does not include any significant amount of water. The carrier component (and thus the magnetorheological fluid) particularly preferably should not include any volatile solvents commonly used in lacquers or compositions that are coated onto a surface and then dried such as toluene, cyclohexanone, methyl ethyl ketone, methyl isobutyl ketone, and acetone. Descriptions of suitable carrier fluids can be found, for example, in U.S. Pat. No. 2,751,352 and U.S. Pat. No. 5,382,373, both hereby incorporated by reference. Hydrocarbons, such as mineral oils, paraffins, cycloparaffins (also known as naphthenic oils) and synthetic hydrocarbons are the preferred classes of carrier fluids. The synthetic hydrocarbon oils include those oils derived from oligomerization of olefins such as polybutenes and oils derived from high alpha olefins of from 8 to 20 carbon atoms by acid catalyzed dimerization and by oligomerization using trialuminum alkyls as catalysts. Such poly-α-olefin oils are particularly preferred carrier fluids. Carrier fluids appropriate to the present invention may be prepared by methods well known in the art and many are commercially available.

The carrier fluid of the present invention is typically utilized in an amount ranging from about 50 to 95, preferably from about 60 to 85, percent by volume of the total magnetorheological fluid.

The magnetorheological fluid can optionally include other additives such as a thixotropic agent, a carboxylate soap, an antioxidant, a lubricant and a viscosity modifier. If present, the amount of these optional additives typically ranges from about 0.25 to about 10, preferably about 0.5 to about 7.5, volume percent based on the total volume of the magnetorheological fluid.

Useful thixotropic agents are described, for example, in WO 94/10693 and commonly-assigned U.S. patent application Ser. No. 08/575,240, incorporated herein by reference. Such thixotropic agents include polymer-modified metal oxides. The polymer-modified metal oxide can be prepared by reacting a metal oxide powder with a polymeric compound that is compatible with the carrier fluid and capable of shielding substantially all of the hydrogen-bonding sites or groups on the surface of the metal oxide from any interaction with other molecules. Illustrative metal oxide powders include precipitated silica gel, fumed or pyrogenic silica, silica gel, titanium dioxide, and iron oxides such as ferrites or magnetites. Examples of polymeric compounds useful in forming the polymer-modified metal oxides include siloxane oligomers, mineral oils and paraffin oils, with siloxane oligomers being preferred. The metal oxide powder may be surface-treated with the polymeric compound through techniques well known to those skilled in the art of surface chemistry. A polymer-modified metal oxide, in the form of fumed silica treated with a siloxane oligomer, can be commercially obtained under the trade names AEROSIL R-202 and CABOSIL TS-720 from DeGussa Corporation and Cabot Corporation, respectively.

Examples of the carboxylate soap include lithium stearate, calcium stearate, aluminum stearate, ferrous oleate, ferrous naphthenate, zinc stearate, sodium stearate, strontium stearate and mixtures thereof.

The viscosity of the magnetorheological fluid is dependent upon the specific use of the magnetorheological fluid. In the instance of a magnetorheological fluid that is used with a damper the carrier fluid should have a viscosity of 6 to 500, preferably 15 to 395, Pa-sec measured at 40° C. in the off-state.

The magnetorheological fluid can be used in any controllable device such as dampers, mounts, clutches, brakes, valves and similar devices. These magnetorheological devices include a housing or chamber that contains the magnetorheological fluid. Such devices are known and are described, for example, in U.S. Pat. No. 5,277,281; U.S. Pat. No. 5,284,330; U.S. Pat. No. 5,398,917; U.S. Pat. Nos. 5,492,312; 5,176,368; 5,257,681; 5,353,839; and 5,460,585, all incorporated herein by reference, and PCT published patent application WO 96/07836. The fluid is particularly suitable for use in devices that require exceptional durability such as dampers. As used herein, "damper" means an apparatus for damping motion between two relatively movable members. Dampers include, but are not limited to, shock absorbers such as automotive shock absorbers. The magnetorheological dampers described in U.S. Pat. No. 5,277,281 and U.S. Pat. No. 5,284,330, both incorporated herein by reference, are illustrative of magnetorheological dampers that could use the magnetorheological fluid.

Examples of the magnetorheological fluid were prepared as follows:

A synthetic hydrocarbon oil derived from poly-α-olefin (available from Albemarle Corp. under the tradename DURASYN 164) was homogeneously mixed with the additives and in the amounts shown in Table 1. To this homogeneous mixture, carbonyl iron (available from GAF Corp. under the tradename R2430) in the amount shown in Table 1 was added while continuing mixing. Fumed silica (available from Cabot Corp. under the tradename CAB-O-SIL TS-720) in the amount shown in Table 1 was then added while continuing mixing. The full formulation then was mixed while cooling with an ice bath to maintain the temperature near ambient. Table 1 shows the composition of the fluids prepared with all quantities in weight percent based on the total weight of the final fluid. In all the fluids the carrier fluid (DURASYN 164) was 70.2 volume %, the carbonyl iron was 25 volume % and the CAB-O-SIL TS-720 was 1.8 volume %.

TABLE 1

| Sample | Organo-molybdenum Molyvan 855 | Amine-alkylphosphate Vanlube 9123 | Non-metal dialkyl-dithiophosphate Vanlube 7611M | Zinc diamyldithio-carbamate Vanlube AZ | Antimony dialkyl-dithiophosphate Vanluble 622 |
|---|---|---|---|---|---|
| Fluid 1 | 0 | 0 | 3.0 | 0 | 0 |
| Fluid 2 | 1.5 | 0 | 1.5 | 0 | 0 |
| Fluid 3 | 0 | 0 | 0 | 2.5[1] | 0.5 |
| Fluid 4 | 0.5 | 0 | 0 | 2.0 | 0.5 |
| Fluid 5 | 1.0 | 0 | 0 | 1.5[1] | 0.5 |
| Fluid 6 | 0 | 0 | 0 | 3.0 | 0 |

[1]An antimony dialkylthiocarbamate (Vanlube® 73 available from R. T. Vanderbuilt) was substituted for the zinc diamyldithiocarbamate.

What is claimed is:

1. A magnetorheological fluid comprising magnetic-responsive particles, a carrier fluid and at least one thiophosphorus additive having a structure represented by:

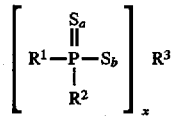

wherein $R^3$ is selected from the group consisting of a metallic ion, a non-metallic moiety and a divalent moiety; a and b are each individually 0 or 1, provided a+b is at least equal to 1; x is an integer from 1 to 5 depending upon the valence number of $R^3$; and $R^1$ and $R^2$ each individually have a structure represented by $$Y-((C)(R^4)(R^5))_n-(O)_w-$$

wherein Y is selected from the group consisting of hydrogen, amino, amido, imido, carboxyl, hydroxyl, carbonyl, oxo and aryl;

n is an integer from 2 to 17;

$R^4$ and $R^5$ can each individually be hydrogen, alkyl or alkoxy; and w is 0 or 1.

2. A magnetorheological fluid according to claim 1, wherein a is 1 and b is 1.

3. A magnetorheological fluid according to claim 1, wherein $R^1$ and $R^2$ are alkyl or alkoxy groups.

4. A magnetorheological fluid according to claim 1, wherein $R^3$ comprises a metallic ion selected from the group consisting of molybdenum, tin, antimony, lead, bismuth, nickel, iron, zinc, silver, cadmium and lead.

5. A magnetorheological fluid according to claim 4, wherein $R^3$ comprises an ionic group selected from the group consisting of a carbide, an oxide, a sulfide and an oxysulfide of molybdenum, tin, antimony, lead, bismuth, nickel, iron, zinc, silver, cadmium or lead.

6. A magnetorheological fluid according to claim 4, wherein $R^3$ comprises a metallic ion selected from the group consisting of antimony, zinc, cadmium, nickel and molybdenum.

7. A magnetorheological fluid according to claim 1, wherein $R^3$ comprises a non-metallic moiety selected from the group consisting of hydrogen, alkyl, alkylaryl, arylalkyl, hydroxyalkyl, oxy-containing group, amido and amino.

8. A magnetorheological fluid according to claim 1, wherein the thiophosphorus additive comprises a dimer wherein $R^3$ comprises an alkylene and x is 2.

9. A magnetorheological fluid according to claim 1, wherein the thiophosphorus additive is selected from the group consisting of sulfurized oxymolybdenum organophosphorodithioate, antimony dialkylphosphorodithioate and molybdenum dialkylphosphorodithioate.

10. A magnetorheological fluid according to claim 1, wherein the thiophosphorus additive is present in an amount of 0.1 to 12 percent by volume, based on the volume of the magnetorheological fluid.

11. A magnetorheological fluid according to claim 1, further comprising at least one additional additive selected from the group consisting of an organomolybdenum, a phosphate, a sulfur-containing compound, and a thiocarbamate having a structure represented by the formula:

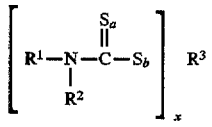

wherein $R^3$ is selected from the group consisting of a metallic ion, a non-metallic moiety and a divalent moiety; a and b are each individually 0 or 1, provided a+b is at least equal to 1; x is an integer from 1 to 5 depending upon the valence number of $R^3$; and $R^1$ and $R^2$ each individually have a structure represented by $$Y—((C)(R^4)(R^5))_n—$$

wherein Y is selected from the group consisting of hydrogen, amino, amido, imido, carboxyl, hydroxyl, carbonyl, oxo and aryl;

n is an integer from 2 to 17; and $R^4$ and $R^5$ can each individually be hydrogen, alkyl or alkoxy.

12. A magnetorheological fluid according to claim 11, wherein the additional additive is present in an amount of 0.1 to 12 percent by volume, based on the volume of the magnetorheological fluid.

13. A magnetorheological fluid according to claim 1, wherein the magnetic-responsive particles have an average particle size of 0.1 to 500 μm.

14. A magnetorheological fluid according to claim 1, wherein the magnetic-responsive particles have an average particle size of at least 1 μm.

15. A magnetorheological fluid according to claim 1, wherein the carrier fluid comprises at least one fluid selected from the group consisting of natural fatty oil, mineral oil, polyphenylether, dibasic acid ester, neopentylpolyol ester, phosphate ester, polyester, cycloparaffin oil, paraffin oil, unsaturated hydrocarbon oil, synthetic hydrocarbon oil, monobasic acid ester, glycol ester, glycol ether, perfluorinated polyether and halogenated hydrocarbon.

16. A magnetorheological fluid according to claim 15, wherein the carrier fluid is selected from the group consisting of mineral oil, paraffin oil, cycloparaffin oil, and synthetic hydrocarbon oil.

17. A magnetorheological fluid according to claim 16, wherein the carrier fluid comprises a synthetic hydrocarbon oil derived from poly-α-olefin.

18. A magnetorheological fluid according to claim 1 wherein the carrier fluid comprises a fluid that is substantially non-volatile, non-polar and non-aqueous.

19. A magnetorheological fluid according to claim 1, wherein the magnetic-responsive particles have an average particle size of 0.1 to 500 μm and the carrier fluid is selected from the group consisting of mineral oil, paraffin oil, cycloparaffin oil, and synthetic hydrocarbon oil.

20. A magnetorheological fluid comprising magnetic-responsive particles, a carrier fluid and at least one thiocarbamate additive having a structure represented by:

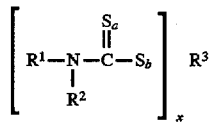

wherein $R^3$ is selected from the group consisting of a metallic ion, a non-metallic moiety and a divalent moiety; a and b are each individually 0 or 1, provided a+b is at least equal to 1; x is an integer from 1 to 5 depending upon the valence number of $R^3$; and $R^1$ and $R^2$ each individually have a structure represented by $$Y—((C)(R^4)(R^5))_n—$$

wherein Y is selected from the group consisting of hydrogen, amino, amido, imido, carboxyl, hydroxyl, carbonyl, oxo and aryl;

n is an integer from 2 to 17; and $R^4$ and $R^5$ can each individually be hydrogen, alkyl or alkoxy.

21. A magnetorheological fluid according to claim 20, wherein a is equal to 1 and b is equal to 1.

22. A magnetorheological fluid according to claim 20, wherein $R^1$ and $R^2$ are alkyl.

23. A magnetorheological fluid according to claim 20, wherein $R^3$ comprises a metallic ion selected from the group consisting of molybdenum, tin, antimony, lead, bismuth, nickel, iron, zinc, silver, cadmium and lead.

24. A magnetorheological fluid according to claim 23, wherein $R^3$ comprises an ionic group selected from the group consisting of a carbide, an oxide, a sulfide and an oxysulfide of molybdenum, tin, antimony, lead, bismuth, nickel, iron, zinc, silver, cadmium or lead.

25. A magnetorheological fluid according to claim 23, wherein $R^3$ comprises a metallic ion selected from the group consisting of antimony, zinc, cadmium, nickel and molybdenum.

26. A magnetorheological fluid according to claim 20, wherein $R^3$ comprises a non-metallic moiety selected from the group consisting of hydrogen, alkyl, alkylaryl, arylalkyl, hydroxyalkyl, oxy-containing group, amido and amino.

27. A magnetorheological fluid according to claim 20, wherein the thiocarbamate additive comprises a dimer wherein $R^3$ comprises an alkylene and x is 2.

28. A magnetorheological fluid according to claim 20, wherein the thiocarbamate additive is selected from the group consisting of molybdenum oxysulfide dithiocarbamate, organo molybdenum dithiocarbamate, zinc diamyldithiocarbamate, lead diamyldithiocarbamate and antimony dialkyldithiocarbamate.

29. A magnetorheological fluid according to claim 20, wherein the thiocarbamate additive is present in an amount of 0.1 to 12 percent by volume, based on the volume of the magnetorheological fluid.

30. A magnetorheological fluid according to claim 20, further comprising at least one additional additive selected from the group consisting of an organomolybdenum, a phosphate and a sulfur-containing compound.

31. A magnetorheological fluid according to claim 30, wherein the additional additive is present in an amount of 0.1 to 12 percent by volume, based on the volume of the magnetorheological fluid.

32. A magnetorheological fluid according to claim 20, wherein the magnetic-responsive particles have an average particle size of 0.1 to 500 μm.

33. A magnetorheological fluid according to claim 20, wherein the magnetic-responsive particles have an average particle size of at least 1 μm.

34. A magnetorheological fluid according to claim 20, wherein the carrier fluid comprises at least one fluid selected from the group consisting of natural fatty oil, mineral oil, polyphenylether, dibasic acid ester, neopentylpolyol ester, phosphate ester, polyester, cycloparaffin oil, paraffin oil, unsaturated hydrocarbon oil, synthetic hydrocarbon oil, monobasic acid ester, glycol ester, glycol ether, synthetic hydrocarbon oil, perfluorinated polyether and halogenated hydrocarbon.

35. A magnetorheological fluid according to claim 34, wherein the carrier fluid is selected from the group consisting of mineral oil, paraffin oil, cycloparaffin oil, and synthetic hydrocarbon oil.

36. A magnetorheological fluid according to claim 35, wherein the carrier fluid comprises a synthetic hydrocarbon oil derived from polyalphaolefin.

37. A magnetorheological fluid according to claim 20, wherein the carrier fluid comprises a fluid that is substantially non-volatile, non-polar and non-aqueous.

38. A magnetorheological fluid according to claim 20 wherein the magnetic-responsive particles have an average particle size of 0.1 to 500 μm and the carrier fluid is selected from the group consisting of mineral oil, paraffin oil, cycloparaffin oil, and synthetic hydrocarbon oil.

39. A magnetorheological fluid according to claim 1 wherein the thiophosphorus additive comprises a metallic dialkyldithiophosphate.

40. A magnetorheological fluid according to claim 20 wherein the thiocarbamate additive comprises a metallic dialkyldithiocarbamate.

41. A magnetorheological fluid according to claim 1 further comprising a carboxylate soap.

42. A magnetorheological fluid according to claim 41 wherein the carboxylate soap is selected from the group consisting of lithium stearate, calcium stearate, aluminum stearate, ferrous oleate, ferrous naphthenate, zinc stearate, sodium stearate and strontium stearate.

43. A magnetorheological fluid according to claim 20 further comprising a carboxylate soap.

44. A magnetorheological fluid according to claim 43 wherein the carboxylate soap is selected from the group consisting of lithium stearate, calcium stearate, aluminum stearate, ferrous oleate, ferrous naphthenate, zinc stearate, sodium stearate and strontium stearate.

* * * * *